US005988541A

United States Patent [19]

Barone

[11] Patent Number: 5,988,541

[45] Date of Patent: Nov. 23, 1999

[54] TRITURATING MACHINE WITH MATERIAL SELECTION AND ROTATING COMPACTOR

[76] Inventor: Giuseppe Barone, Via Senatore Edoardo Battaglia, 36, 90018 Termini Imerese, Italy

[21] Appl. No.: 08/816,385

[22] Filed: Mar. 13, 1997

[30] Foreign Application Priority Data

Mar. 26, 1996 [IT] Italy ..... 96A0005

[51] Int. Cl.[6] ..... B02C 18/22

[52] U.S. Cl. ..... 241/100; 241/101.2; 241/101.78; 241/223; 241/224

[58] Field of Search ..... 241/243, 101.78, 241/101.2, 236, 223, 186.35, 100, 99, 606, 224, 225

[56] References Cited

U.S. PATENT DOCUMENTS

| | | | |
|---|---|---|---|
| 4,205,794 | 6/1980 | Horton et al. | 241/606 |
| 5,048,764 | 9/1991 | Flament . | |

FOREIGN PATENT DOCUMENTS

| | | | |
|---|---|---|---|
| 0 543 763 | 5/1991 | European Pat. Off. . | |
| 0 589 281 | 3/1994 | European Pat. Off. . | |
| 0 682 983 | 11/1995 | European Pat. Off. . | |
| 2 690 094 | 10/1993 | France . | |
| 2 701 874 | 9/1994 | France . | |
| 3907813 | 11/1989 | Germany . | |
| 29515698 | 2/1996 | Germany . | |
| 9401060 | 2/1996 | Netherlands . | |
| 2221405 | 2/1990 | United Kingdom | 241/99 |
| 2277247 | 10/1994 | United Kingdom . | |
| WO 88/04578 | 6/1988 | WIPO . | |

*Primary Examiner*—Mark Rosenbaum
*Attorney, Agent, or Firm*—Daniel O'Byrne

[57] ABSTRACT

A refuse trituration-compaction machine including: a rotating loading inlet with a cylindrical portion and a pivoting sack-pushing flap for pushing material into the machine; a horizontal conveyor belt for transporting the refuse from the loading inlet to a rotating cutter element in which the conveyor belt is provided with a pivoted portion arranged above the rotating cutter element for allowing material blocked on the rotating cutter element to pass under the upwardly pivoted belt portion; a pivoted presser plate movable between a work position for compacting refuse in a containment bin and a non-working position arranged distally from the rotating cutter element such that material may fall directly from the rotating cutter element into the containment bin; a complementary cutter element removably arranged adjacent the rotating cutter element with spaced-apart fixed blades for arrangement between a cutter blades of the rotating cutter element spaced apart by intermediate spacer disks, and a presser device slidably mounted on the complementary cutter element for pressing refuse material between said fixed blades and said cutter blades, and including plates connected to a movable end portion of the presser device and extending for arrangement between the cutter blades of the rotating cutter element, and raised portions provided on the intermediate spacer disks for grazing the fixed blades of the complementary cutter element; and a user control system including a magnetically coded card identifying each user of the machine, a magnetic card reader for reading the magnetically coded card, and a computer system for processing data including refuse amount data and time of conferment data related to each specific user.

14 Claims, 12 Drawing Sheets

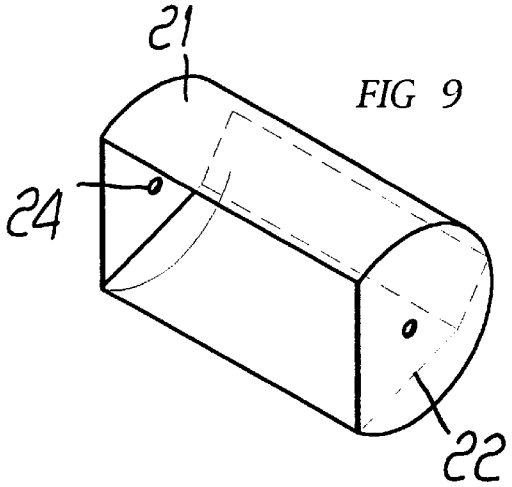
FIG 9
FIG. 10
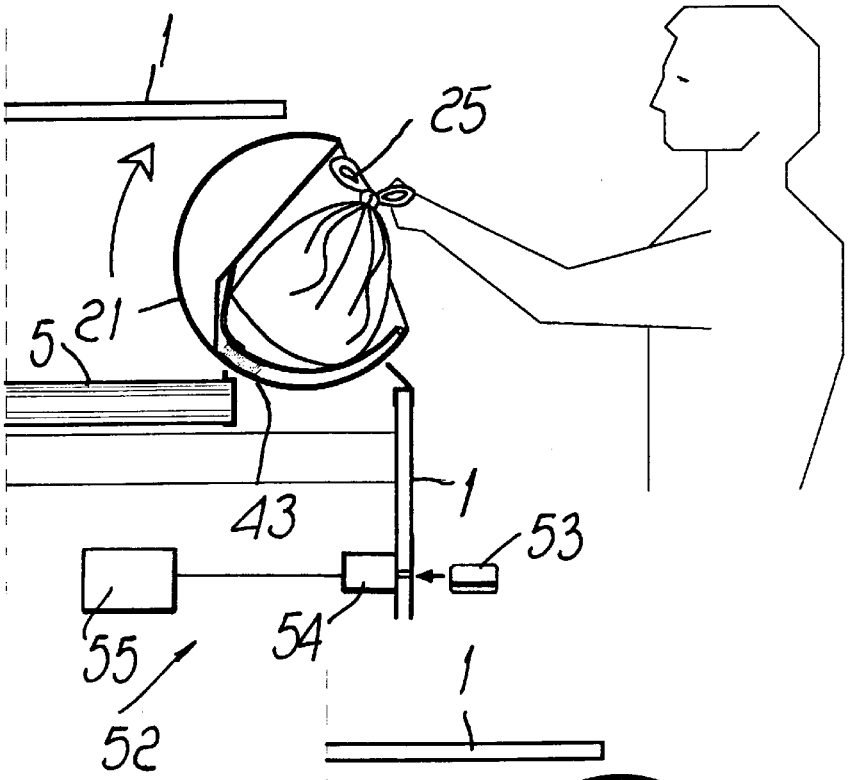
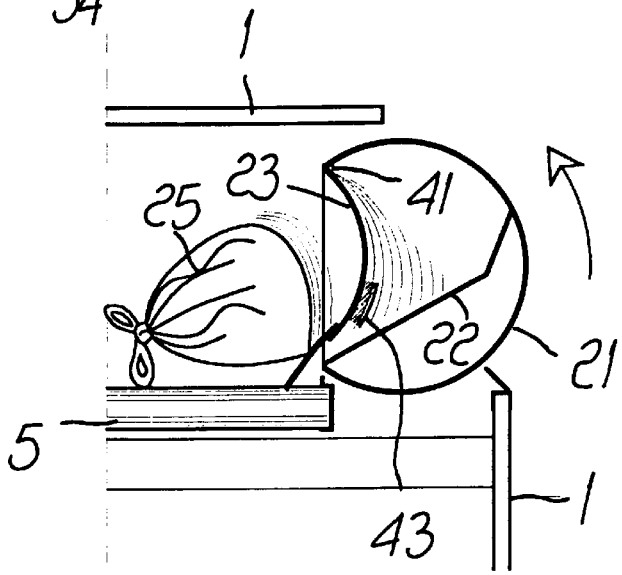
FIG. 11

TRITURATING MACHINE WITH MATERIAL SELECTION AND ROTATING COMPACTOR

BACKGROUND OF THE INVENTION

The present invention relates to a triturating machine with material selection and a rotating compactor.

Machines for triturating composite materials, such as solid urban wastes, are known and described for example in published European Patent Application No. 682,983, the disclosure of which is incorporated herein by reference.

SUMMARY OF THE INVENTION

The present invention provides improvements to known triturating machines. In particular, the gathering, trituration, and compaction of conferred refuse is optimised according to preferred aspects of the invention.

According to a preferred aspect of the invention, both the triturating apparatus and the compactor apparatus of the machine of the invention are provided with a very low height, and, by virtue of the particular rotating press system, may be boxed in a single block having a parallel piped shape with reduced dimensions.

Such a system allows to facilitate the introduction of the refuse and the exit of the bin for containing the treated material on its own wheels at ground level.

All of the loading and discharge operations are, therefore, provided at the height of the human operator.

According to a further aspect of the invention, a triturating-compaction matching is provided which has been designed and constructed so as not to require any kind of surveillance or instructions relative to the nature and volume of the refuse introduced, since all of the materials passing through the loading inlet will be easily treated in the system.

Improvements in material trituration and compaction are provided by a machine as defined in the appended claims.

BRIEF DESCRIPTION OF THE DRAWINGS

The particular technical characteristics and advantages of the invention will become apparent to a skilled person in the art from the following detailed description of some preferred but not exclusive embodiments of a triturating-compaction machine according to the invention, described hereinafter and illustrated in the accompanying drawings only by way of non-limitative example in which:

FIG. 9 is a perspective view of a roller shaped inlet of the machine according to the invention;

FIG. 10 is a side elevation view of the roller shaped inlet of FIG. 9 in a material loading position;

FIG. 11 is a side elevation view of the roller shaped inlet of the previous FIGS. 9 and 10 in an unloading position;

DESCRIPTION OF THE PREFERRED EMBODIMENTS

Figure 1:
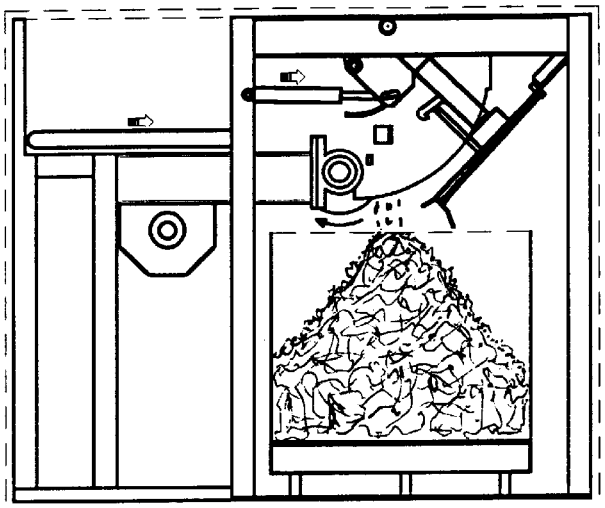
FIGS. 1–5 are schematic side elevation views of a triturating-compaction machine according to the invention in successive operating phases.

In the drawing Figures, like reference numerals indicate like parts.

The introduction of material sin the triturating-compaction machine is allowed through loading inlets 21 (FIG. 9), of a predetermined dimension, which has the scope of limiting the size of the bags containing the refuse to be introduced in the machine.

Upon opening such inlets, in fact, a preestablished volume is formed, into which it is possible to introduce the refuse to be treated.

It would be impossible to introduce refuse having a volume or length which is greater than that which is permitted by the loading inlets.

The roller shaped inlet 21 is connected in the machine according to the invention so that it rotates on a rotation axis 24 and always assures the expulsion of the introduced materials into the inside of the machine.

The loading position (FIG. 10) disposes the loading inlet in open position, with the opening of the loading inlet positioned to face the outside of the external cabin 1 of the machine, allowing the introduction of material into the internal structure 3 of the machine for eventual treatment by the material trituration system and material compaction system located in the internal structure 3.

During this position, by virtue of its perfectly cylindrical form with a closed semi-cylindrical outer wall portion which fits between the external cabin walls 1, the user is not able to access the internal parts of the machine with his hands or with various objects, which renders the machine particularly safe.

In the loading position a sack-pushing flap 23 settles in a rest position, by gravity or positioned by means of springs, lever systems or other adapted systems, upon a lower part of the inlet 21, allowing to place a sack thereupon.

In the unloading position (FIG. 11), the inlet 21 rotates about 160°, directing the opening of the inlet towards the inside of the machine.

In this manner the material 25 slides upon a sliding plate 22, whereupon it is deposited on a conveyor belt 5, which carries it towards the triturating apparatus of the machine.

In the discharge phase of the material (FIG. 11), in order to avoid that such material 25 remains by friction, due to its shape or characteristics, upon the sliding plate 22 without rolling or sliding onto the conveyor belt 5, an expulsion system is connected to the inlet 21, in the form of the sack-pushing flap 23 which has the function of pushing the sack of material 25 towards the conveyor belt 5.

Said flap, in fact, which in the position of loading the sack or other material is positioned to rest in the lower sector of the inlet, rotates during the rotation of the inlet 21 in order to pushes the sack or material towards the belt.

This pushing force is actuated by means of the rotation of the flap which, being pivoted at an upper pivot axis 41, tends due to gravity to be displaced towards the belt, aided by a counterweight 43, or other suitable system such as springs, levers, etc. which push the material upon the belt.

Figure 13:
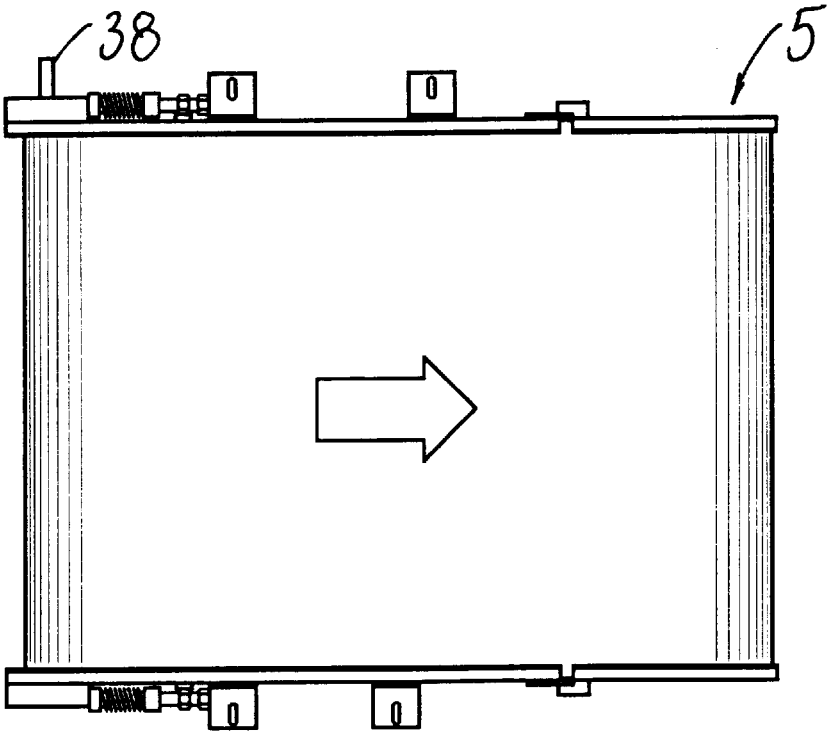
FIG. 13 is a plan view of a conveyor belt for a triturating-compaction machine according to the invention.

The particular configuration of the inlet 21 and the sack-pushing flap 23 permits to position the triturating apparatus in the machine at a level which is higher with respect to known machines, and hence the internal sliding at a vertical hopper of known machines is eliminated. Moreover, in order to further limit the height of the machine, there is provided the conveyor belt 5 (FIGS. 13 to 15) which develops on a substantially horizontal or slightly inclined plane.

Such conveyor belt 5 is provided with a motorized belt shaft 38 and a pivoting system 39 at its unloading end, positioned adjacent a rotating cutter element 29 having a rotation shaft 36 rotatably accommodated in a pair of bridge supports 13 (FIGS. 12 and 20) fixed laterally with the cabin 1 of the machine and rotatable by means of a rotor group rotation reduction motor 4 appropriately connected to the rotation shaft 36 of the rotating cutter element 29.

Such pivoting system allows the unloading end portion of the belt to rotate upwardly (FIG. 15), if residual materials are not fully triturated at a first pass, allowing in such case the passage of said residual materials between the cutter element 29 and the bottom of the raised end portion of the belt 5 to a successive trituration process.

Figure 14:
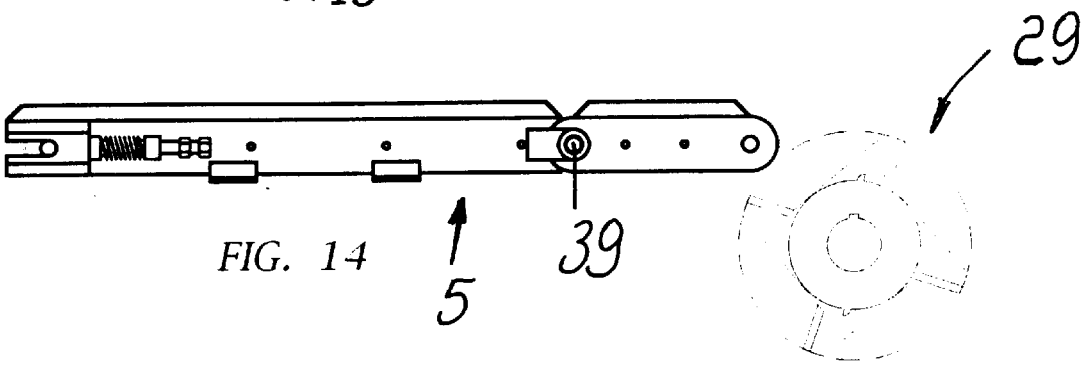
FIGS. 14 and 15 are side elevational views of the conveyor belt of FIG. 13 respectively in normal and upwardly rotated positions.
Figure 15:
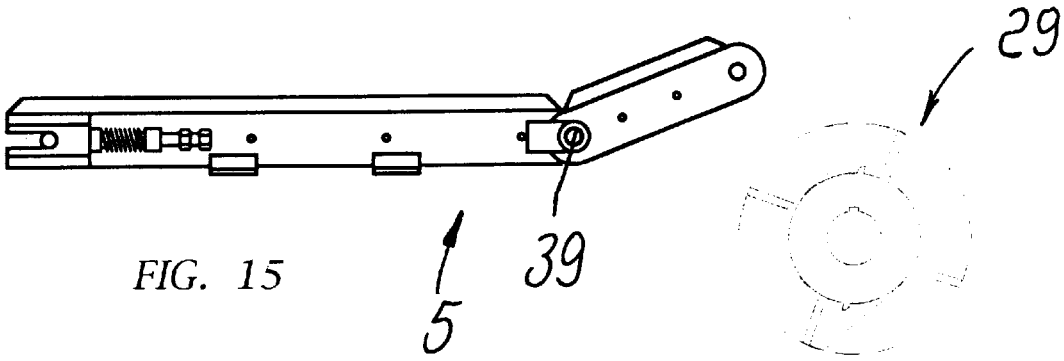

During normal functioning, instead, the materials are sent to the trituration process (FIG. 14).

Figure 16:
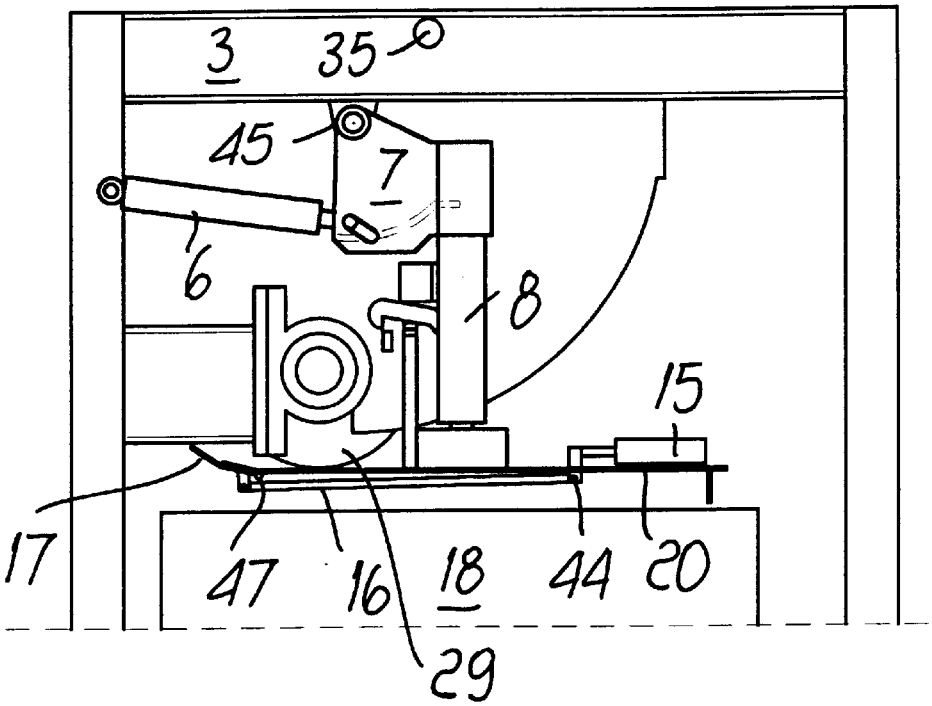
FIGS. 16 and 17 are side elevation detail views of a material compaction system for a machine according to the invention showing successive operating positions of a rotating presser plate.
Figure 17:
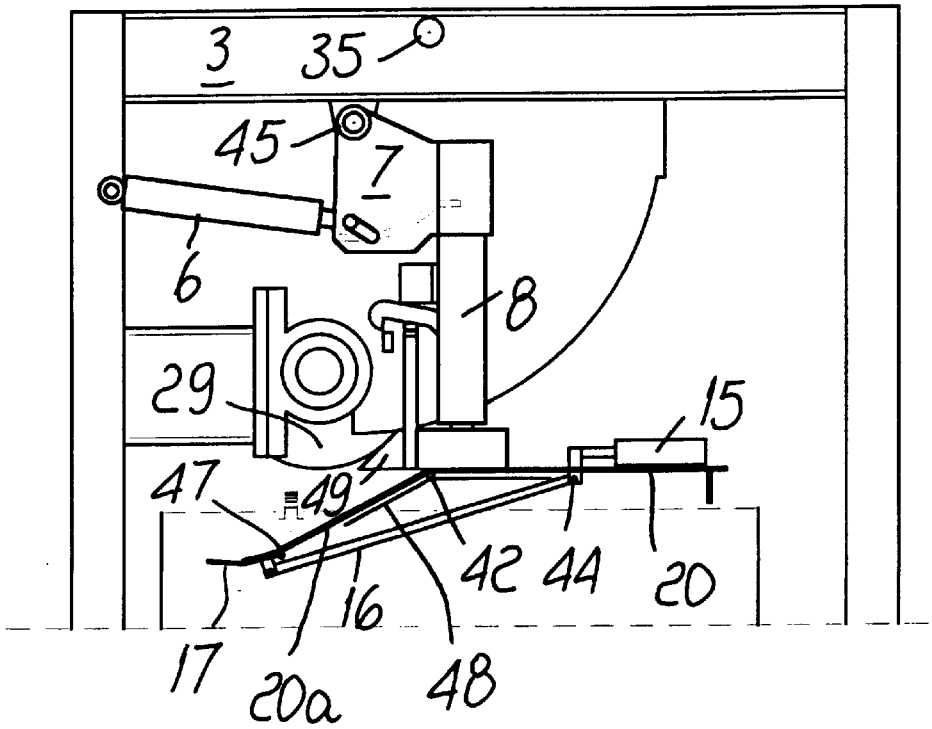

Referring to FIGS. 16 and 17, a material compaction system of the machine according to the invention comprises a rotating presser plate 20, which allows to optimise the dimensions and the final volume of the triturating-compaction machine. Such rotating plate 20 brings about, with respect to the known devices, the advantage of transporting the triturated materials directly from the triturating device to the underlying bin, eliminating the circular transporting device described in the above-identified published European Patent Application No. 682,983. In this manner, the space is optimised by reducing the dimensions of the machine.

The plate 20, by virtue of its functioning, is characterised by two principle positions.

The plate 20 is in a rest position (shown schematically in FIG. 1) during the trituration phase, and it is in a work position for smoothing out, levelling, and pressing materials during a non-trituration phase (FIGS. 2, 3, 4 and 5).

Figure 2:
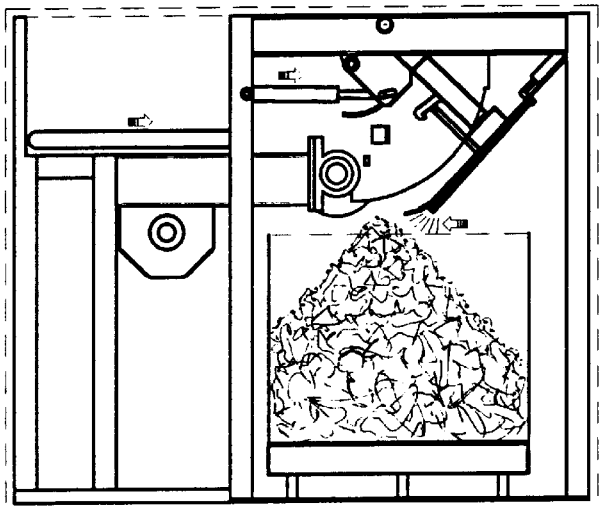
Figure 3:
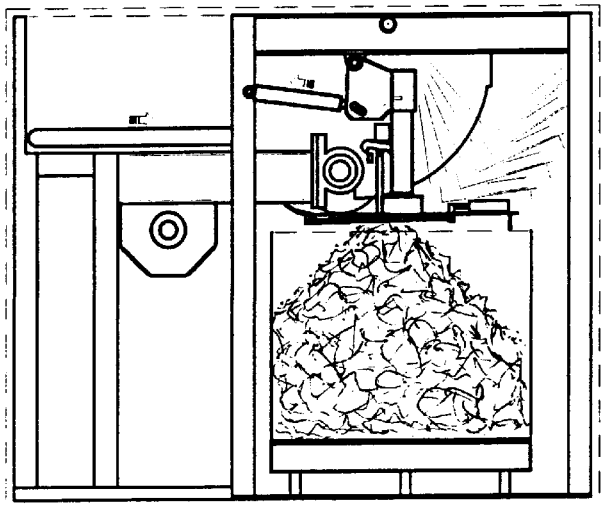
Figure 4:
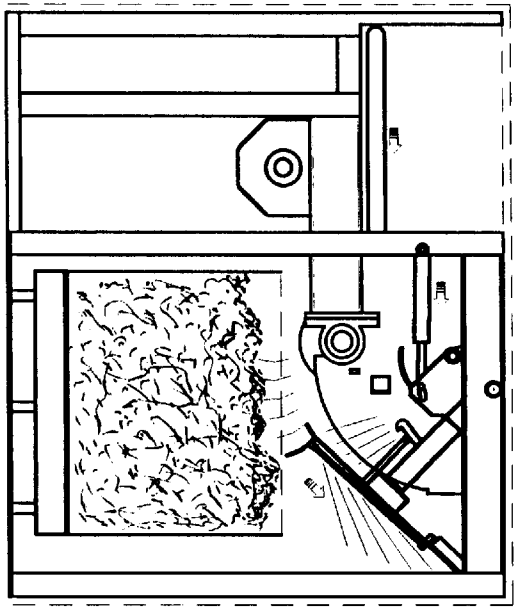

A smoothing and levelling cylinder 15 (FIG. 12) connected at one end of the plate 20 transmits a rotation of about 90° to a smoothing and levelling plate 17 which is pivoted at a pivot axis 47 to the plate 20, by means of a rod 16 slidingly connected with respect to the plate 20 and interconnected between the cylinder 15 and the smoothing and levelling plate 17, so as to bring the plate 17 in a position substantially parallel or slightly raised with respect to the plate 20 (FIG. 2).

Figure 12:
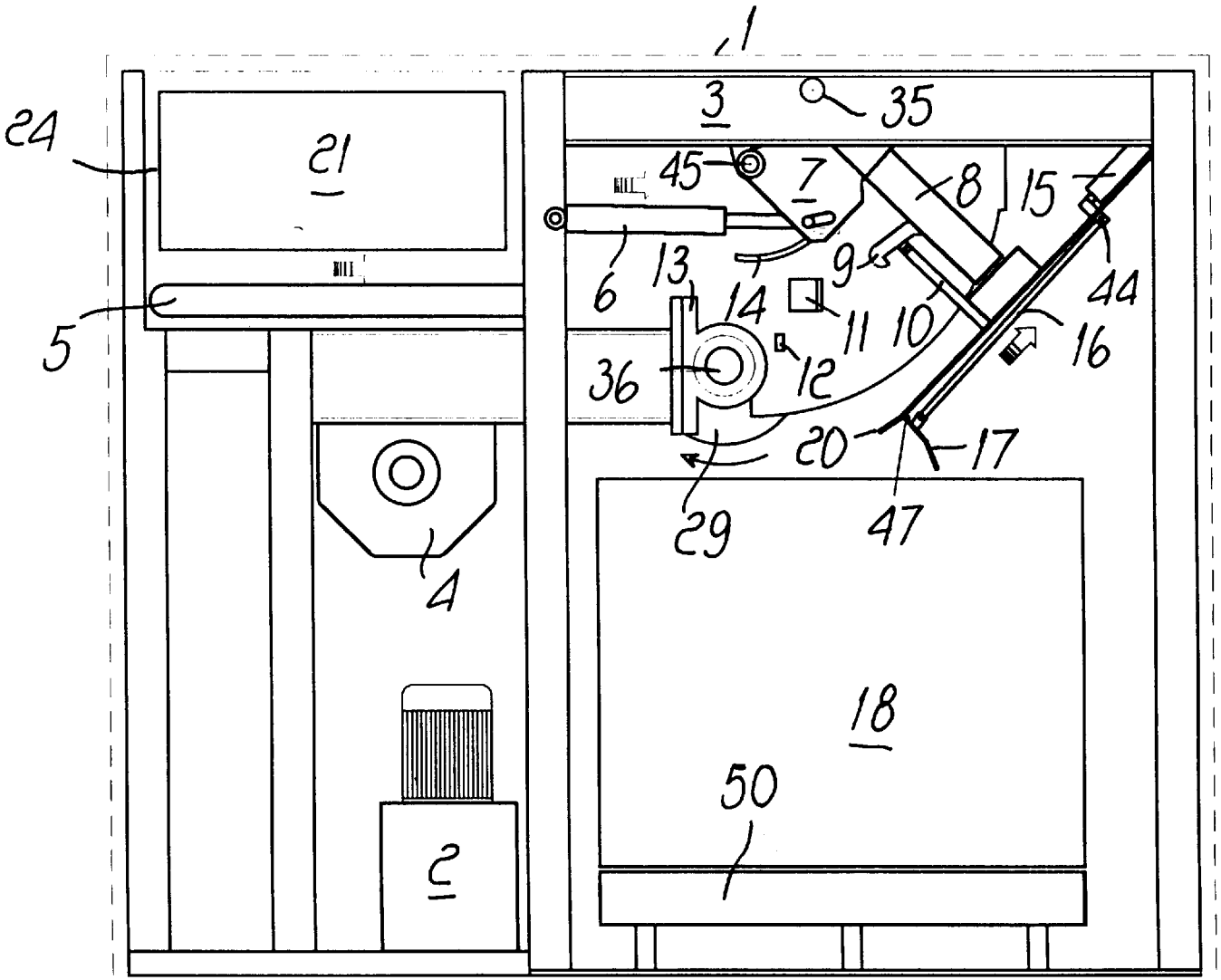
FIG. 12 is a side elevation view of a triturating-compaction machine according to the invention, in which a side panel of the external cabin of the machine is removed for illustrating the internal moving parts of the machine.

Successively the return of a rotating press command cylinder 6 actuates a rotation to a group formed by the rotating press and its components, about an attachment pivot 45, in such a manner to horizontally position the plate 20 of the rotating press in the area below the trituration device (FIG. 3) until the complete movement of a pressing cylinder 8 against an abutment 11 protruding from a side wall portion of the cabin 1 (FIGS. 12, 16, and 17). The group formed by the rotating press and its components includes the rotating presser plate 20 and the components supported thereby, pressing cylinder 8, and a support bracket 7 which supports pressing cylinder 8 such that pressing cylinder 8 is interconnected between the support bracket 7 and the presser plate 20, and which support bracket 7 is pivotally movable about the axis of the attachment pivot 45 pivotally connecting the support bracket 7 between side wall portions of the cabin 1 of the machine. The support bracket 7 includes a pin means slidably disposed in a slide 14 with a circular arc portion provided in a cabin side wall portion and the rotating press command cylinder 6 is interconnected between a fixed wall of the cabin 1 and the bracket 7 for effectuating rotation of the bracket 7 and the presser plate 20 and pressing cylinder 8 connected thereto about the axis of the attachment pivot 45.

FIGS. 12, 16, and 17 illustrate single cylinders 6 and 8 however it is preferable that at least two each of cylinders 6 and 8 are provided at opposite ends of support bracket 7, and opposite side wall portions of the cabin 1 are each provided with a respective slide 14 in which the pin means of the bracket 7 are slidably accommodated. Similarly a pair of pistons 15 and rods 16 are preferably provided at opposite sides of presser plate 20 for actuating the pivoting movement of smoothing and levelling plate 17.

Once the above-described horizontal position (FIG. 3) of presser plate 20 is reached, the smoothing and levelling plate 17, by means of the return of the cylinder 15, connected to the rod 16, rotates about 90°, returning to its original position in which its plane of lay extends substantially transverse with respect to the plane of the plate 20.

Just as the plate 17 reaches such position, the press newly returns in a raised position by means of the pushing of the cylinder 6, actuating a smoothing out and levelling (FIG. 4) of the accumulated material present in a containment bin 18 of the machine.

Figure 5:
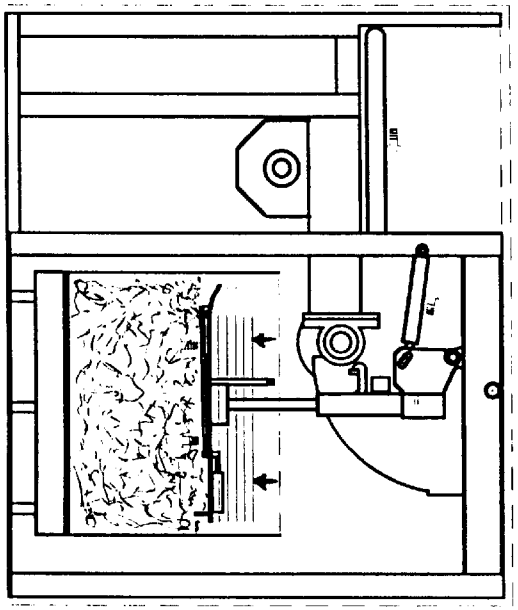
Figure 8:
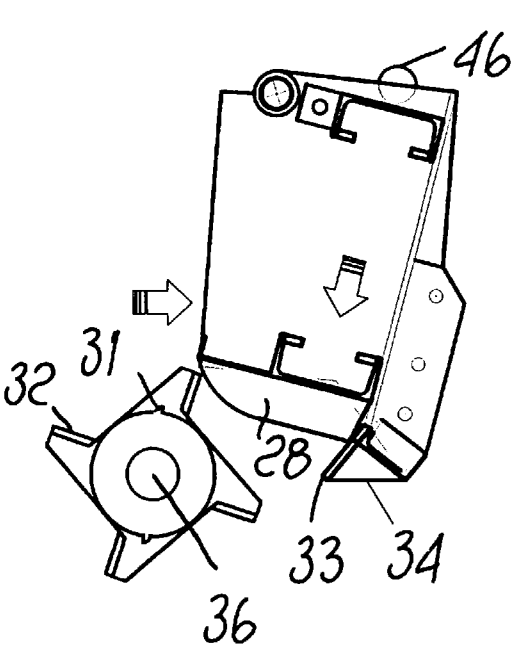
FIGS. 6–8 are side elevational views of different arrangements of a rotating cutter element relative to a pivoting countercutter for a triturating-compaction matching according to the invention.
Figure 7:
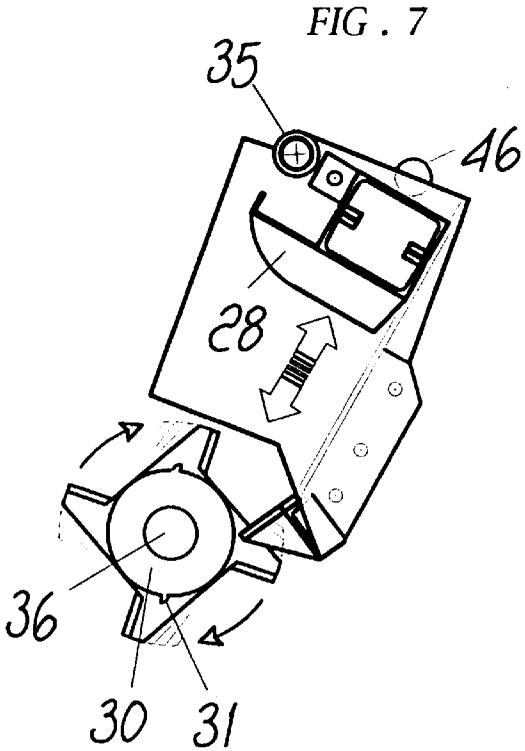
Figure 6:
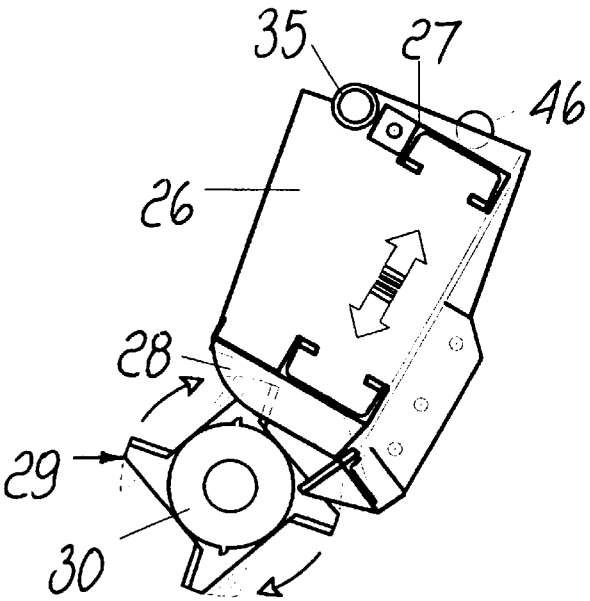

Following the above described phases, the press 20 newly reaches the lowered position (FIG. 3) whereupon the descent cycle is activated in order to thus begin the pressing phase by actuation of the cylinder 8 (FIG. 5).

In this phase, a safety hook 9 (FIG. 12) pivotally connected to pressing cylinder 8 enters into action, assuring the perfectly vertical descent of the press by locking the group formed by the press and its components in place. Hook 9 is releasably engageable with a connection plate 12 protruding from a side wall portion of cabin 1 for releasably locking the presser group in place.

The hooking and unhooking of the hook 9 from the connection plate 12 occurs mechanically, by means of a moving hook release rod 10 slidably connected with the pressing cylinder 8 for engaging the pivoting hook 9, or by means of another suitable system.

Once the pressing is carried out, the plate 20 newly reaches the raised non-working position (FIG. 1), so as to wait for a new pressing cycle.

Once the non-working position of the plate 20 is achieved, the machine is ready for the trituration cycle of the materials contained therein.

All of the phases actuated by the machine are managed in a completely automatic manner by means of an electronic control system for the motor 4 for rotation of the rotating cutter element 29 and for the motorized belt shaft 38 for actuation of the material conveyor belt 5, and further in cooperation with a central oleodynamic exchange 2 for feeding the various command cylinders of the machine.

In the event that there is material which must be subjected to a further trituration processing and which is therefore caught or blocked on the rotating cutter 29, and therefore which is not clear of such phase such that the blocked material is in a position to interfere with the pivoting presser plate 20 in its movement into the horizontal position (FIGS. 3 and 16), when the described pressing system enters into action, a pivoting presser plate portion 20*a* of the presser plate 20 (FIG. 17) which is supported by flat flexible leaf springs 48 is able to rotate when it encounters the blocked material about the axis of a hinge pivot 42 pivotally connecting the portion 20*a* to the main portion of the presser plate 20 so as to move away from the triturating device and be able to reassume, under force of the leaf springs 48, the original horizontal position during the phase of descent and pressing. The levelling device command rod 16 is also provided with end attachment pivots 44 for permitting the rotation of presser portion 20*a*.

Abutment means preferably in the form of two abutments 49 extending from the main portion of the presser plate 20 are provided for blocking, during the pressing phase, the plate portion 20*a* so as not to allow such plate to rotate upwardly.

A presser device 27 (FIGS. 6–8 and 21–22), for pressing the material loaded in the region between the cutter element 29 and a complementary cutter element 26, is slidably mounted on the complementary cutter element 26.

Such complementary cutter element 26 is movable towards and away from the cutter element (FIGS. 6–8) by having its main frame being pivoted about a rotation shaft 35 extending between lateral wall portions of the cabin 1 of the machine, and by being activated by at least one command cylinder 40 interconnected between a fixed portion of the cabin 1 and a distal end of the complementary cutter element 26.

Figure 22:
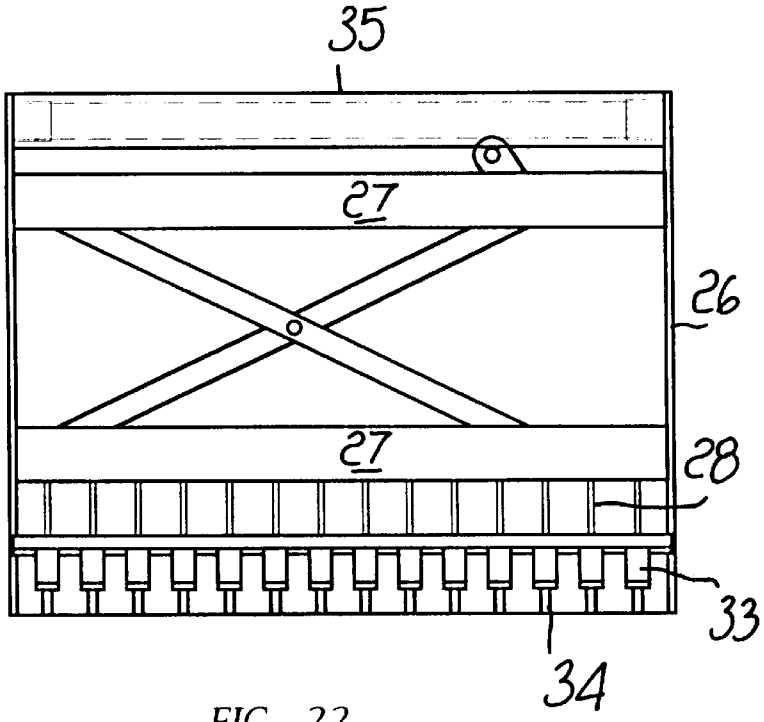
FIGS. 21 and 22 are front elevation views of a presser device mounted on the pivoting countercutter element of FIGS. 6 to 8.
Figure 21:
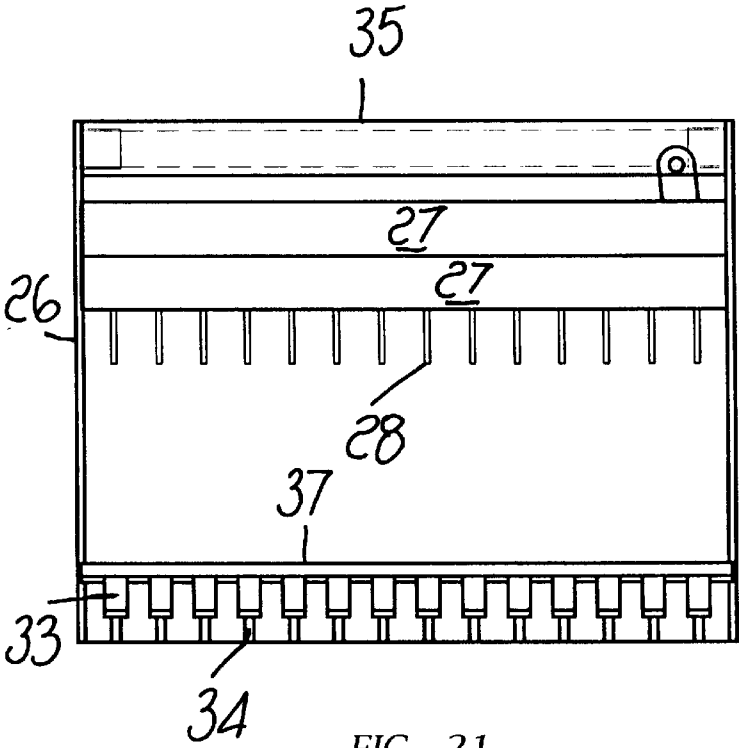
Figure 23:
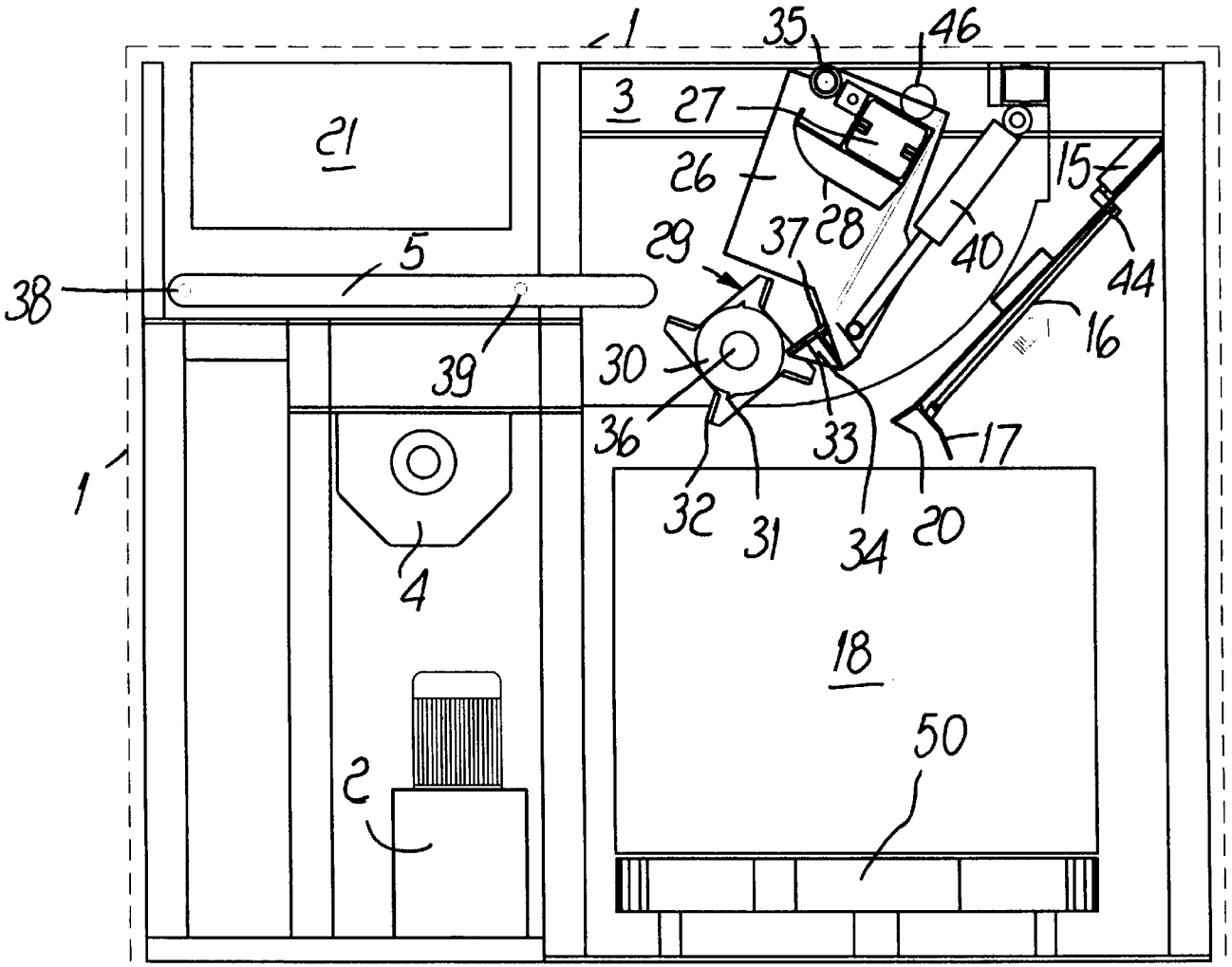
FIG. 23 is a side elevation view of the machine similar to FIG. 12, in which part of the rotating presser group and a side panel have been eliminated in order to show the rotating cutter element and pivoting countercutter of FIGS. 6–8 arranged internally in the machine.

As seen in FIGS. 21–23, the presser device 27 is in the form of a pantograph press with one movable end slidably connected to the main frame of the complementary cutter element 26 and being actuatable by means of a command cylinder 46.

With such an arrangement, the presser device 27 advantageously allows to aid the complementary cutter element 26 in its movement away from the cutter element 29 when material is blocked upon the latter, since the presser device may simultaneously press against the blocked material when the command cylinder 40 for pivoting the complementary cutter element 26 is activated.

It allows moreover to unblock the blocked material, since the presser device 27 may still press against the blocked material even when the complementary cutter element 26 is arranged distally from the cutter element 29. The presser device 27 also allows to block the passage of non-triturated material through the space between the cutter element and the complementary cutter element arranged distally, blocking the non-triturated material possibly arriving from the conveyor belt 5. The pressure device 27 is therefore activated by the command cylinder 40 independently of the position of the complementary cutter element 26 with respect to the rotating cutter element 29 so as to be able to assume a plurality of useful positions.

The presser device 27 is necessary for the triturating phase, and useful for the comprehensive functioning of the machine, and operates in a manner as described in the above-identified published European Patent Application No. 682,983.

In fact, it pushes the material in a group of spaced apart cutter blades 32 of the rotating cutter element 29, and it has been further supplied, with respect to the the technology indicated in the above-identified published European Patent Application No. 682,983, with a series of plates 28 made of metal or other suitable material, positioned on the lower part of the sliding plate of the pantograph presser 27, and extending in planes transversely to the rotation shaft 36 of the cutter element 29 and parallel to the planes of the cutter blades 32. In a lowered position of the sliding plate of the pantograph presser 27 and when the complementary cutter element 26 is arranged adjacent the rotating cutter element 29 (FIG. 6), the plates 28 are inserted between the spaces between the blades 32 of the triturator defined by the intermediate disks 30 interposed between such blades.

The function of the plates 28 is to press, and to engage and crush between the blades 32 of the rotating cutter element 29, in less time with respect to the technology indicated in the above-identified published European Patent Application No. 682,983, all rigid plate or sheet-like material, such as cardboard, plywood and other materials which have a flat surface and a small thickness, upon which the blades of the cutter element, for geometric reasons, would be slow to engage.

The plates 28 insure the engagement of the blades 32 on this material, in order to allow the trituration thereof.

The absence of such presser device 27 would bring about the placing down of the above-described materials upon the group of cutters 29 such that they were not triturated, consequently with the positioning above of other material which itself would not be triturated, interrupting in such manner the functionality of the machine and requiring the intervention of the assigned operator.

The triturating-compaction machine described herein does not require any intervention on the part of assigned operators for the carrying out of the operations of trituration of refuse having unusual nature and dimensions, such as cardboard, fabrics, rags, wooden boxes, etc. . . . such that the machine possesses 100% efficiency in complete absence of assigned operators during its operation.

Another improvement which has been provided with respect to the above-identified published European Patent Application No. 682,983 concerns the containment bin 18 for the triturated refuse (FIG. 12) which, after its filling, resulted relatively difficult to extract in order to empty it due to the weight of the mass of gathered refuse.

Figure 25:
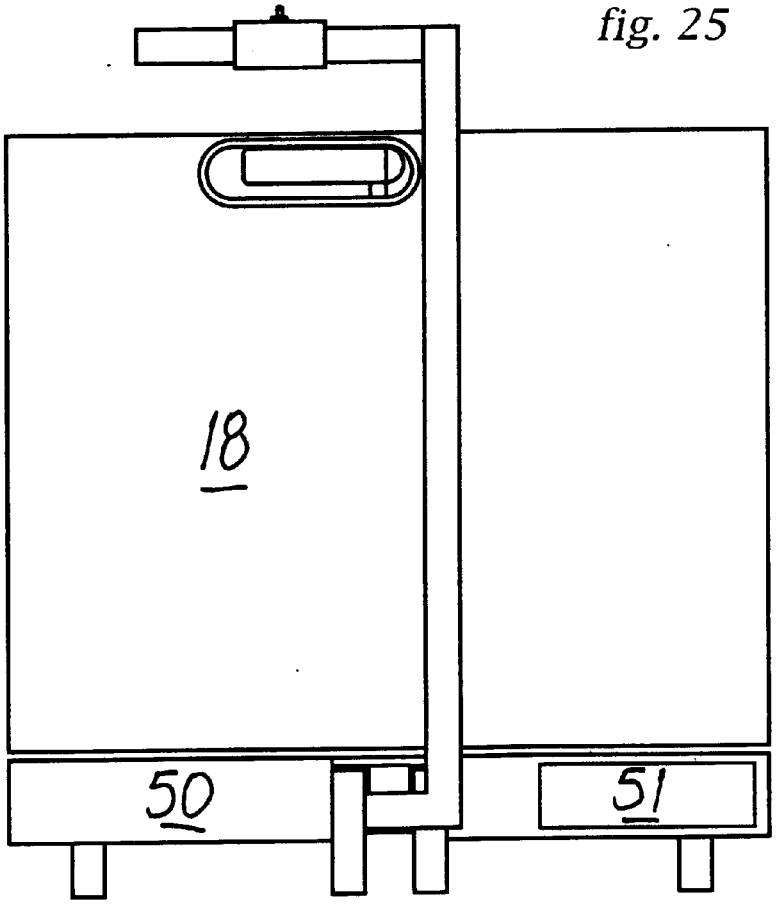
FIG. 25 is a side elevation detail view of a bin for a machine according to the invention.

For this purpose, there has been added a motorized mobile wheeled platform 50 (FIG. 25) upon which the container is fixed.

On such platform has been connected a reduction motor unit fed by an accumulator 51 situated at the edge of the mobile platform.

Such accumulator recharges itself automatically, when the bin is inserted in its housing, during the phase of trituration.

Moreover, an easy separation of the two elements (the motorised platform 50 and the containment bin 18) has been provide din order to facilitate the cleaning and maintenance of the bin.

Figure 18:
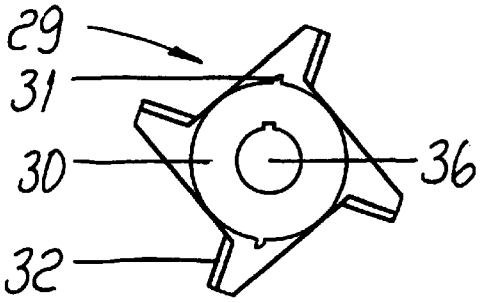
FIG. 18 is a side elevation view of spacer disk of a rotating cutter element according to the invention.
Figure 19:
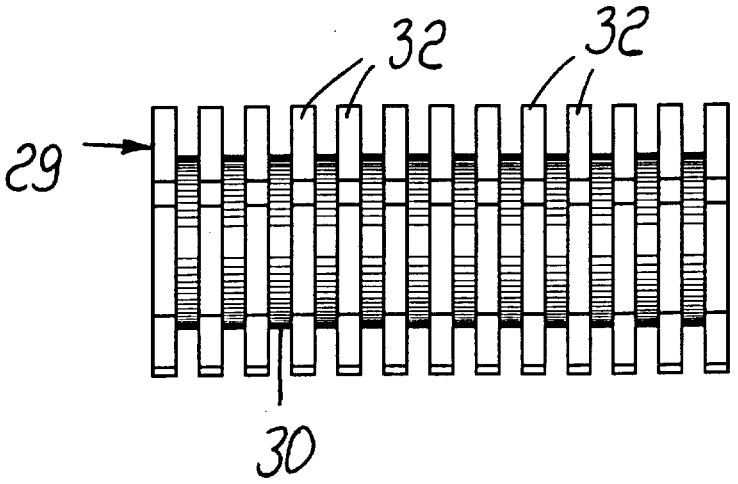
FIG. 19 is a front elevation view of a rotating cutter element according to the invention.
Figure 20:
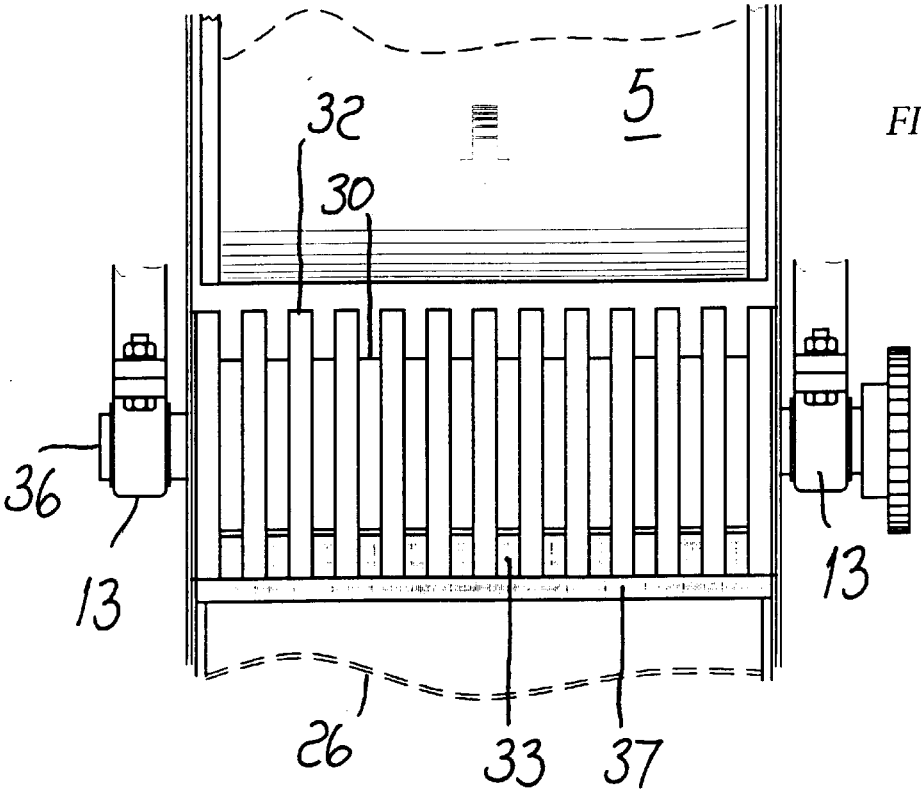
FIG. 20 is a plan view of an arrangement of a rotating cutter element, complementary cutter element, and conveyor belt in the machine according to the invention.

Another modification provided with respect to the above-identified published European Patent Application No. 682, 983 concerns the application on the intermediate spacer disks 30 of raised portions 31 (FIG. 18). These raised portions are adapted to graze the frontal sides of a plurality of fixed blades 33 (FIGS. 20–23) supported by a plurality of supports 34 connected to a frontal bar 37 provided at the distal end of the complementary cutter element 26 when the complementary cutter element is arranged in a working position adjacent the rotating cutter element 29 (FIG. 23), and the fixed blades 33 are dimensioned for close fitting between the rotating cutter blades 32 as seen in FIG. 20, thereby to actuate a trituration on four sides so as to insure the complete elimination, in less time with respect to the prior art, of possible fibrous material which could wrap in the trituration device.

Figure 24:
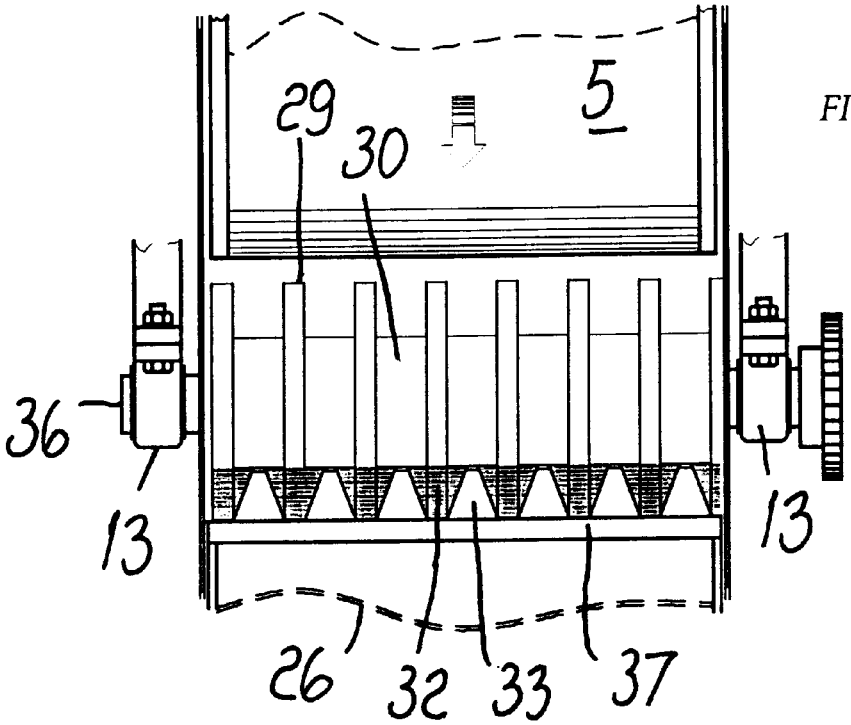
FIG. 24 is view similar to FIG. 20, showing an alternative form of the cutters and counter cutters.

FIG. 24 illustrates a variation in the shape of the fixed blades 33 which now have a truncated triangular shape in cross section with the base fitting closely between the spacing of the rotating cutter blades 32 and with the truncated portion arranged for grazing with the raised portions 31 of the intermediate spacer disks 30.

According to a further aspect of the invention, the waste triturating and compaction matching includes a user control system 52 (FIG. 10) including a magnetically coded card 53 identifying each user of the machine, a magnetic card reader 54 preferably located near the loading inlet 21 for reading each card 53 inserted therein, and a general purpose computer system 55 including preferably a central processing unit, a memory for storing data, programs, and the like, an input system for receiving data and programs, an output system such as a computer screen and/or a printer for communicating data to a user, and electronic hardware, and/or software for selectively activating or reconfigurating the computer system 55 for performing the functional steps of the invention which will be described hereinafter. The various parts of the computer system 55 are electronically interconnected in a conventional manner, and the computer system 55 is also electronically connected to the magnetic card reader 54 for receiving data therefrom read from the coded magnetic card 53.

The computer system 55 may be electronically connected with a blocking system for the loading inlet 21 in order to permit the opening of such loading inlet 21 only when valid magnetically coded cards 53 are introduced into the magnetic card reader 54. For each user of a card 54, data may be processed by the computer system 55 in order to provide the exact time of introduction of material into the machine by a user, and the quantity (volume and/or weight) of material conferred at each specific time an dover a given period of time, for example either by keeping track of the number of times the loading inlet 21 is rotated to confer material (volume) and/or by means of appropriate balance weighting systems (weight), at the times when a given card 54 inserted in the reader 54 has provided access to a user. In such a manner, the exact quantity of material conferred by a specific user over a specific time may be effectively and efficiently calculated, thereby providing a precise and rational means for levying a fair tariff on each specific user.

Figure 26:
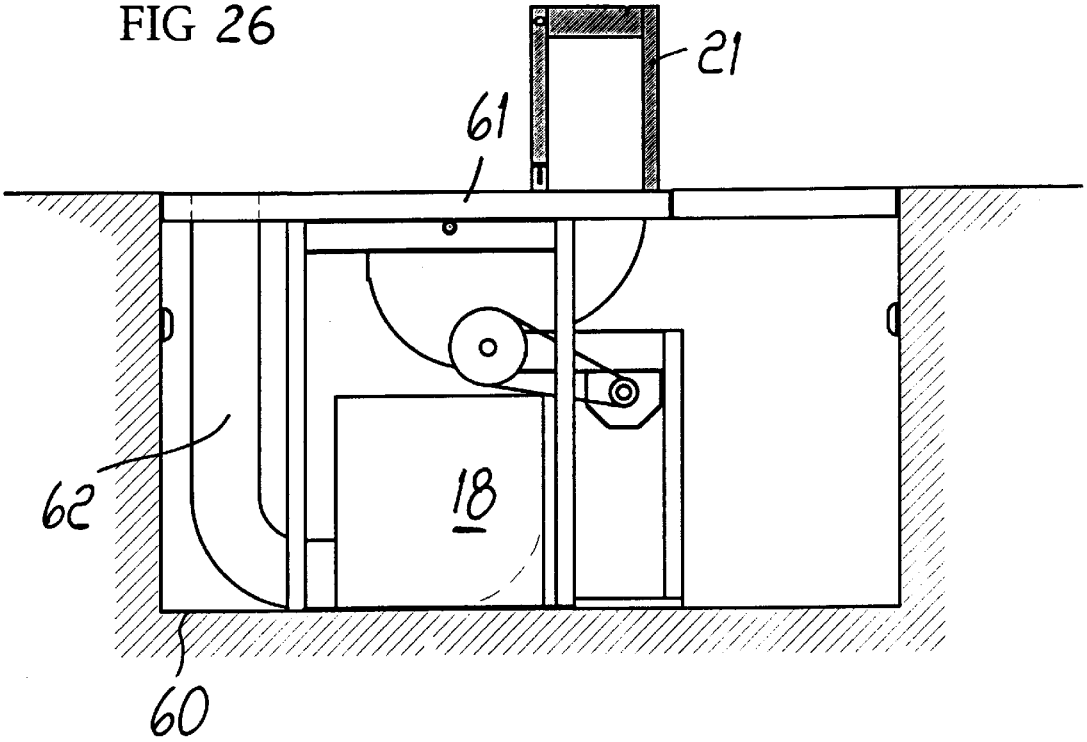
FIG. 26 is a side elevation view of a trituration-compaction machine according to the invention arranged under ground level.

FIG. 26 shows a trituration-compaction machine according to another aspect of the invention, in which the machine is disposed under ground level inside a pit or underground cabin 60 comprising a cover 62, such that only the loading inlet 21 is arranged above ground level for access by a user. In this case, the emptying of the containment bin may be performed directly by means of a suction duct 62 attached to an appropriate suction apparatus, or by means of an appropriate underground conveyor system connected to the underground cabin 60 and eventually to the containment bin 18.

Figure 27:
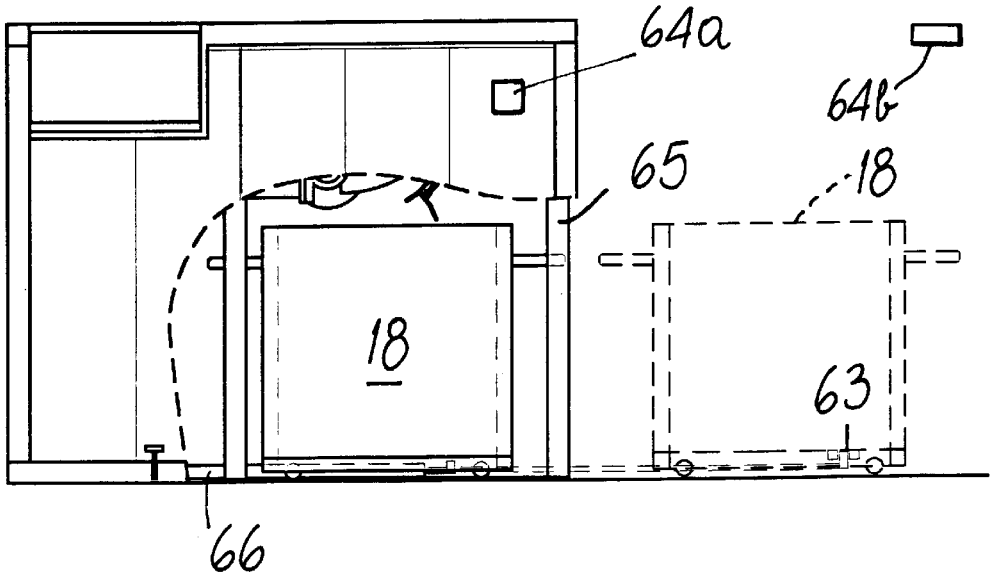
FIG. 27 is a partially cutaway side elevation view of a trituration-compaction machine according to the invention provided with a distance-command operating system for automatically accessing the containment bin of the machine.

FIG. 27 shows a trituration-compaction machine in accordance with a further aspect of the invention, which includes a distance-command operating system for automatically accessing the containment bin 18 of the machine. This configuration is particularly convenient for allowing the emptying and replacement of the containment bin 18 for example by a single truck operator in a manner such that the operator need not exit from the vehicle, since the operations of accessing the containment bin may be performed by distance-command. The distance-command operating system may include a radio command **64*b* for sending appropriate signals to a receiver 64*a* operatively connected in the machine, such that the vertical opening and closing movements of an electronic sliding door 65 and the horizontal movements of the wheeled containment bin 18 are selectively controlled. Receiver 64*a* is operatively connected to a fluid activated piston system 66 selectively connected to the containment bin 18 at 63 for providing the movement of the bin. The containment bin 18 positioned outside of the external cabin of the machine is shown in phantom lines in FIG. 27**.

What is claimed is:

1. A trituration-compaction machine for triturating and compacting refuse material, comprising;

an external cabin;

a loading inlet for introducing the refuse material inside the external cabin;

a trituration device located inside the cabin and including a rotating cutter element for triturating refuse material;

a containment bin for holding refuse material triturated by said trituration device; and a compaction device for compacting the triturated material inside the containment bin; and a loading inlet with a substantially cylindrical portion and a longitudinal axis about which the loading inlet is rotatable between a first loading position for receiving the refuse material and a second unloading position for delivering the refuse material inside the external cabin, said loading inlet with a substantially cylindrical portion being provided with a pivoted sack-pushing flap which in said first loading position is positioned adjacent a lower part of said loading inlet such as to define a space inside the loading inlet sufficient for receiving refuse material to be treated and which in said second unloading position is biased to pivot away from said lower part whereby to decrease said space inside the loading inlet and to push material out of said loading inlet inside said cabin.

2. The trituration-compaction device of claim 1, wherein said sack-pushing flap is biased to pivot in the second unloading position by means of gravity, and wherein a counterweight is provided on a portion of said sack-pushing flap distally from a pivot attachment axis for pivoting said flap to said loading inlet.

3. A trituration-compaction matching for triturating and compacting refuse material, comprising:

an external cabin;

a loading inlet for introducing the refuse material inside the external cabin;

a trituration device located inside the cabin and including a rotating cutter element for triturating refuse material;

a containment bin for holding refuse material triturated by said trituration device;

a compaction device for compacting the triturated material inside the containment bin;

a loading inlet for receiving the refuse material and for delivering the refuse material inside the external cabin;

a conveyor belt disposed in a substantially horizontal plane of lay and extending between said loading inlet and said rotating cutter element for delivering refuse material from said loading inlet to said rotating cutter element, said conveyor belt having a first end arranged below said loading inlet and a second end arranged above said rotating cutter element, and wherein said second end of said conveyor belt is pivoted with respect to a main portion of the conveyor belt such as to be able to pivot upwardly away from said rotating cutter element whereby to permit refuse material blocked on said rotating cutter element to pass between said rotating cutter element and the second end of said conveyor belt in an upwardly pivoted position.

4. A trituration-compaction machine for triturating and compacting refuse material, comprising:

an external cabin;

a loading inlet for introducing the refuse material inside the external cabin;

a trituration device located inside the cabin and including a rotating cutter element for triturating refuse material;

a containment bin for holding refuse material triturated by said trituration device;

a compaction device for compacting the triturated material inside the containment bin; and a movable presser plate of said compaction device movable between a work position in which the presser plate is arranged below the trituration device and at an upper portion of said containment bin for being activated to compact the triturated refuse inside said containment bin and a non-working position in which the presser plate is arranged distally from said trituration device for allowing material to fall directly from said trituration device into said containment bin.

5. The trituration-compaction device of claim 4, wherein said movable presser plate is pivoted about an attachment pivot axis and wherein the machine further comprises means for pivoting said movable presser plate between said working and non-working positions.

6. The trituration-compaction device of claim 4, further comprising means for releasably locking said movable presser plate in said working position.

7. The trituration-compaction device of claim 4, wherein said movable presser plate comprises a levelling plate for providing smoothing and levelling of refuse material inside said containment bin, said levelling plate being pivotally mounted at one end of said movable presser plate and being movable between a first position in which the levelling plate extends substantially parallel to a main portion of said presser plate and a second position in which the levelling plate extends substantially perpendicularly to the main portion of said presser plate.

8. The trituration-compaction device of claim 4, wherein said movable presser plate comprises a central hinge pivot for mutually pivotally connecting two main portions of said movable presser plate such that one of said two main portions may pivot downwardly below said rotating cutter element whereby for permitting material blocked on said rotating cutter element to pass between said rotating cutter element and said one of said two main portions in a pivoted lowered position.

9. The trituration-compaction device of claim 4, further comprising:

a loading inlet with a substantially cylindrical portion and a longitudinal axis about which the loading inlet is rotatable between a first loading position for receiving the refuse material and a second unloading position for delivering the refuse material inside the external cabin; and a conveyor belt disposed in a substantially horizontal plane of lay and extending between said loading inlet and said rotating cutter element for delivering refuse material from said loading inlet to said rotating cutter element.

10. The trituration-compaction device of claim 9, further comprising a complementary cutter element removably arranged adjacent said rotating cuter element of said trituration device and including a plurality of spaced-apart fixed blades for arrangement between a plurality of cutter blades spaced of the rotating cutter element spaced apart by means of a plurality of intermediate spacer disks, and a presser device slidably mounted on said complementary cutter element for pressing refuse material between said fixed blades and said cutter blades.

11. The trituration-compaction device of claim 10, further comprising a plurality of plates connected to a movable end portion of said presser device and extending therefrom for arrangement between the cutter blades of said rotating cutter element.

12. The trituration-compaction device of claim 11, further comprising raised portions provided on said intermediate spacer disks for grazing said fixed blades of said complementary cutter element.

13. The trituration-compaction device of claim 12, further comprising a user control system including a magnetically coded card identifying each user of the machine, a magnetic card reader for reading the magnetically coded card, and a computer system for processing data including refuse amount data and time of conferment data related to each specific user.

14. The trituration-compaction device of claim 13, wherein said containment bin is provided with a wheeled motorized mobile platform.

* * * * *